US006315014B1

(12) United States Patent
Chang

(10) Patent No.: US 6,315,014 B1
(45) Date of Patent: Nov. 13, 2001

(54) WOOD PLANING MACHINE WITH TOOL ACCOMMODATING FUNCTION

(75) Inventor: Chiu-Tsun Chang, Taichung (TW)

(73) Assignee: P & F Brother Industrial Corporation, Taichung (TW)

( * ) Notice: Subject to any disclaimer, the term of this patent is extended or adjusted under 35 U.S.C. 154(b) by 0 days.

(21) Appl. No.: 09/664,313

(22) Filed: Sep. 18, 2000

(51) Int. Cl.[7] ..... B27C 1/00

(52) U.S. Cl. ..... 144/117.1; 144/130; 144/285; 144/286.5; 312/237

(58) Field of Search ..... 144/114.1, 116, 144/117.1, 130, 285, 286.1, 286.5; 312/237, 249.7

(56) References Cited

U.S. PATENT DOCUMENTS 1,535,964 * 4/1925 Vetter ..... 144/285
2,646,330 * 7/1953 Swainbank ..... 144/285
5,595,228 * 1/1997 Meisner et al. ..... 144/285
6,085,812 * 7/2000 Chiang ..... 144/130

* cited by examiner

*Primary Examiner*—W Donald Bray
(74) *Attorney, Agent, or Firm*—Baker Botts L.L.P.

(57) ABSTRACT

A wood planing machine with a tool accommodating function includes a machine frame having an upper portion, and a tool box having a lower box body mounted securely on the upper portion of the machine frame. The lower box body confines a tool accommodating space adapted to receive tools therein, and has an open top side. The tool box further includes an upper cover body with a rear side edge hinged to the lower box body. The upper cover body is movable relative to the lower box body so as to selectively open and close the open top side of the lower box body.

6 Claims, 4 Drawing Sheets

WOOD PLANING MACHINE WITH TOOL ACCOMMODATING FUNCTION

BACKGROUND OF THE INVENTION

1. Field of the Invention

The invention relates to a wood planing machine with a tool accommodating function, more particularly to a wood planing machine having an upper portion provided with a tool box.

2. Description of the Related Art

With reference to FIG. 1, a conventional wood planing machine 10 generally includes a pair of upright threaded rods 11 (only one is shown) disposed at opposite end portions thereof and linked by a drive chain (not shown), an upper cover 12, a hand wheel 13 disposed on one side of the upper cover 12 and coupled to the threaded rods 11, and a cutter carriage 14 mounted on the threaded rods 11. The cutter carriage 14 has a planing cutter (not shown) disposed at a bottom portion thereof to plane a workpiece (not shown). The hand wheel 13 is operable to rotate the threaded rods 11 to result in vertical movement of the cutter carriage 14 along the threaded rods 11 for cutting the workpiece at a determined level.

However, the conventional planing machine 10 is not constructed to have a tool accommodating space for holding tools, such as screw drivers, spanners, and blades, which are necessary for maintaining the planing machine 10 or replacement of parts thereof. Without a fixed place to keep the necessary tools, the tools are often scattered on or around the planing machine 10, and the user may take a long time to find a suitable tool, hence resulting in poor work efficiency.

SUMMARY OF THE INVENTION

Therefore, the main object of the present invention is to provide a wood planing machine with a tool accommodating function to facilitate use.

Accordingly, a wood planing machine with a tool accommodating function of the present invention includes a machine frame having an upper portion, and a tool box having a lower box body mounted securely on the upper portion of the machine frame. The lower box body confines a tool accommodating space adapted to receive tools therein, and has an open top side. The tool box further includes an upper cover body with a rear side edge hinged to the lower box body. The upper cover body is movable relative to the lower box body so as to selectively open and close the open top side of the lower box body.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
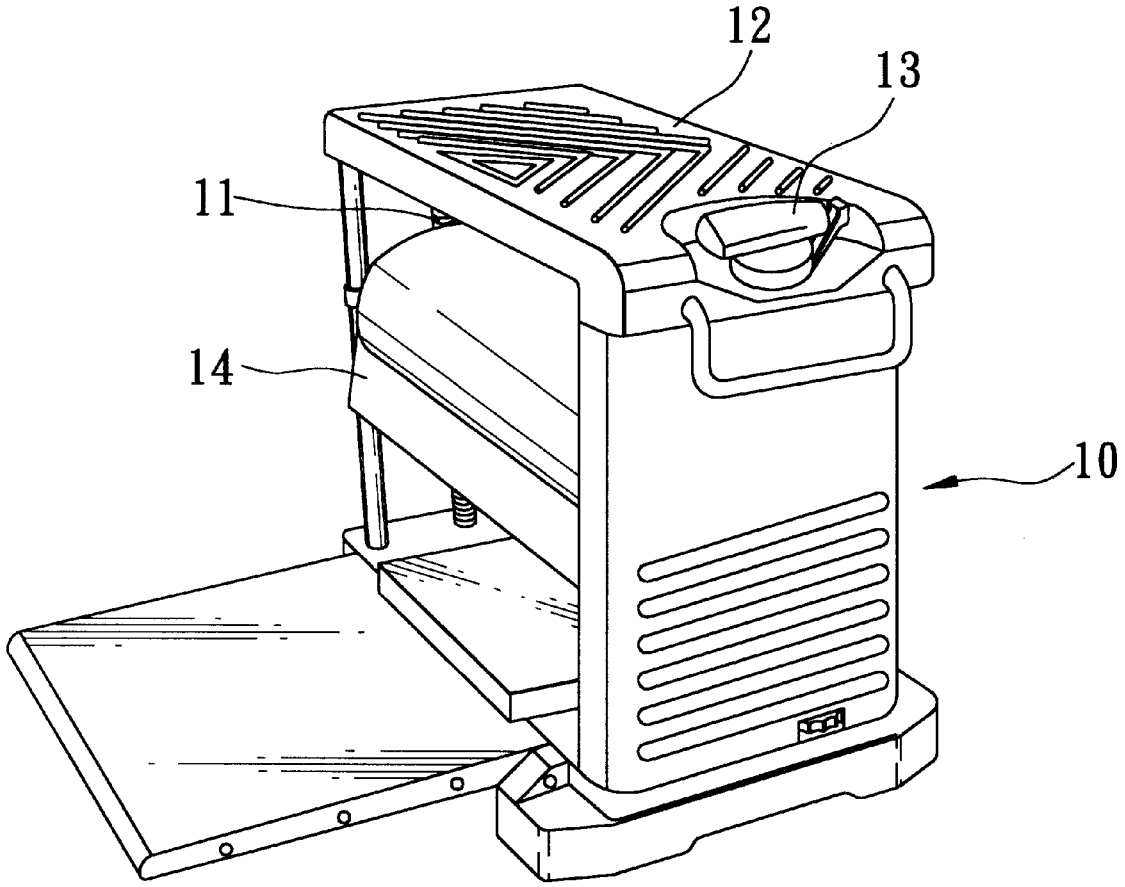
FIG. 1 PRIOR ART
FIG. 1 is a perspective view of a conventional planing machine.
Figure 2:
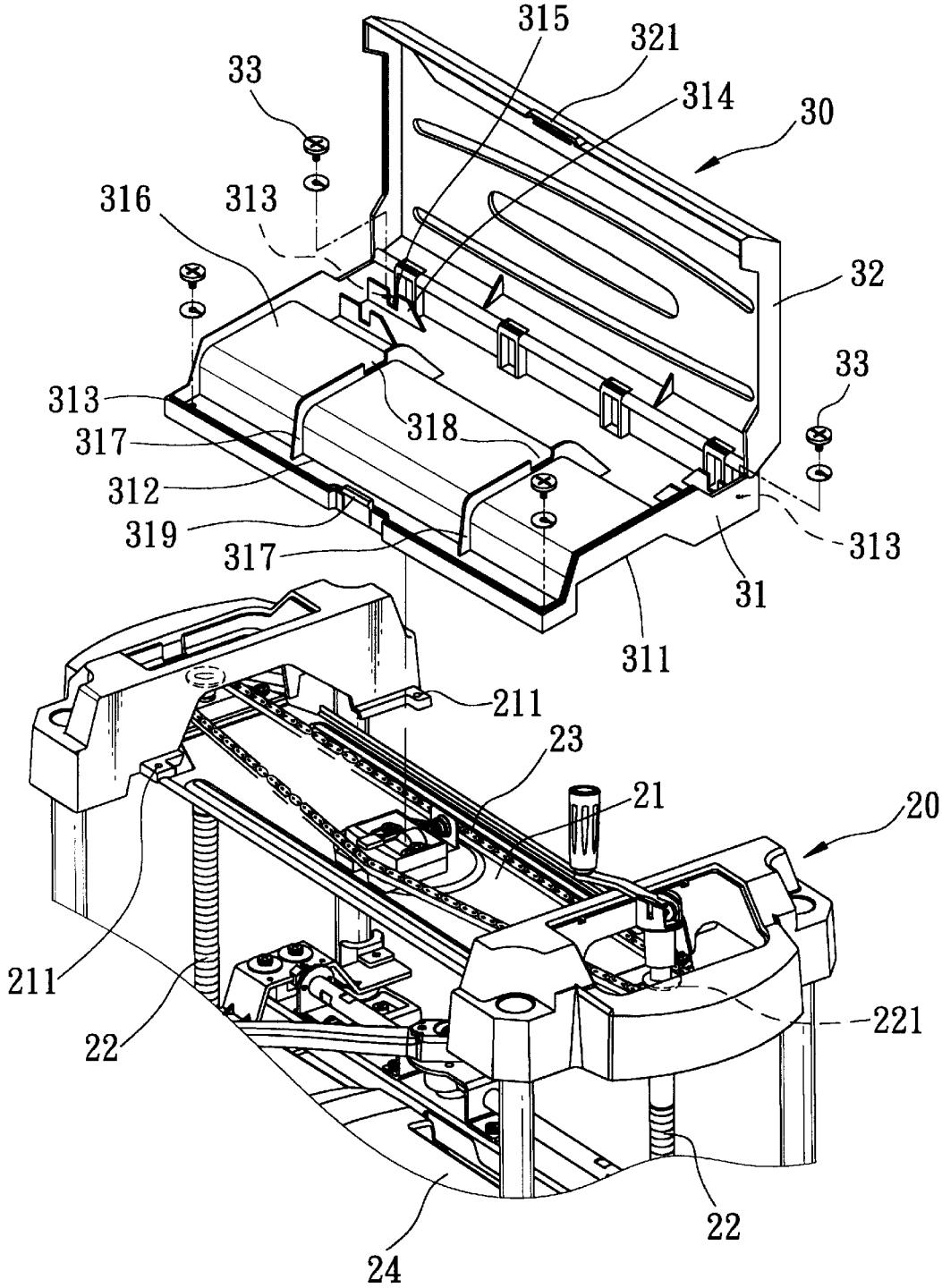
FIG. 2 is a fragmentary partly exploded perspective view of the preferred embodiment of a planing machine with a tool accommodating function according to the invention.
Figure 3:
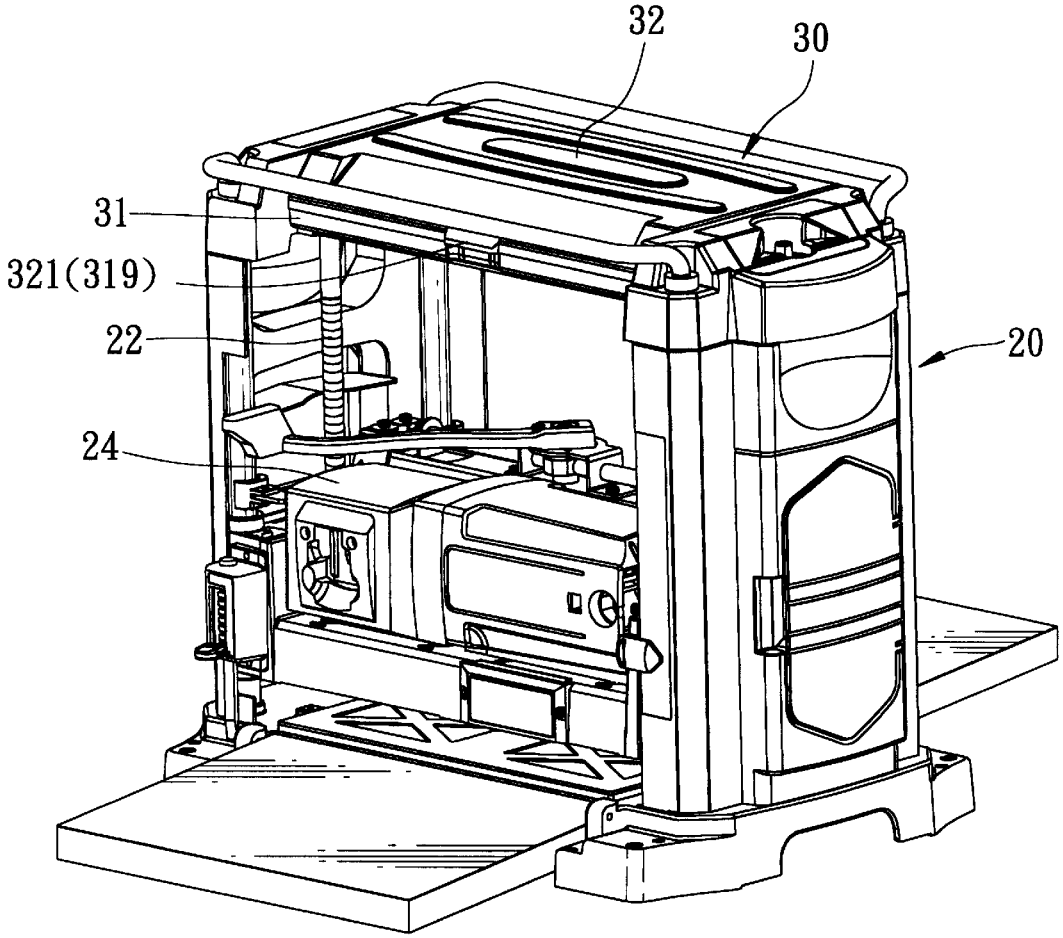
FIG. 3 is an assembled perspective view of the preferred embodiment.
Figure 4:
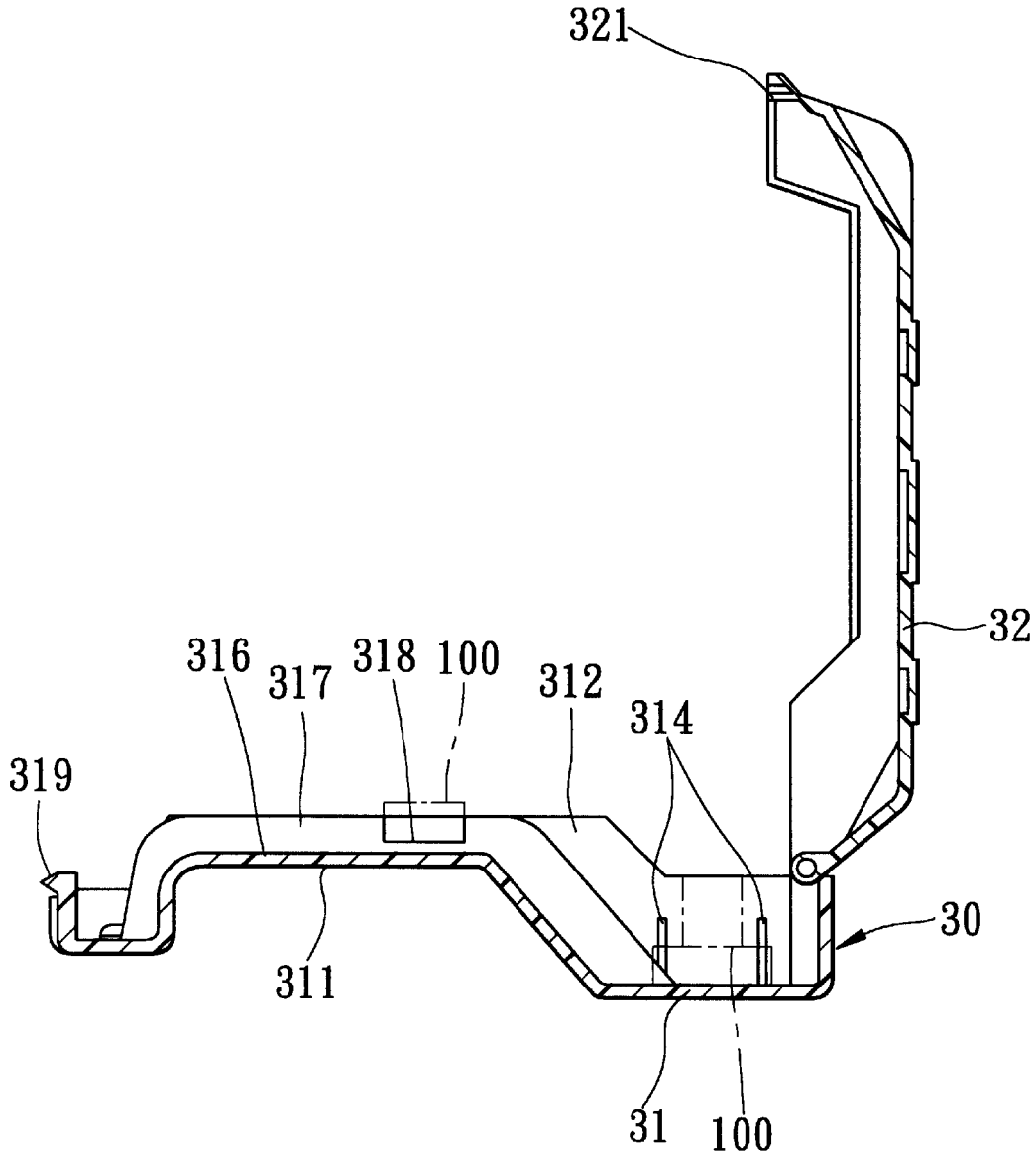
FIG. 4 is a side sectional view of a tool box of the preferred embodiment.

Referring to FIGS. 2 to 4, the preferred embodiment of a wood planing machine with a tool accommodating function according to the present invention is shown to include a machine frame 20 and a tool box 30. The machine frame 20 has an upper portion, and includes a horizontal tray frame 21 disposed at the upper portion. The machine frame 20 further includes a pair of upright threaded rods 22 disposed at opposite end portions of the tray frame 21 and having upper ends that extend rotatably through the tray frame 21, a pair of sprockets 221 mounted on the upper ends of the threaded rods 22, an endless drive chain 23 trained on the sprockets 221, and a cutter carriage 24 having a planing cutter (not shown) disposed at a bottom portion thereof and carried by the threaded rods 22 such that rotation of the threaded rods 22 relative to the tray frame 21 results in vertical movement of the cutter carriage 24 along the threaded rods 22 for cutting a workpiece (not shown) at a determined level.

The tool box 30 includes a lower box body 31 mounted on top of the tray frame 21 disposed at the upper portion of the machine frame 20. The lower box body 31 confines a tool accommodating space 312 adapted to receive tools 100, such as spanners, screw drivers, blades, etc., associated with planing and having an open top side, and has left and right side edges, and a bottom wall with a bottom surface formed with a chain channel 311, and a top surface formed with a parallel pair of upwardly projecting tool retaining plates 314. The chain channel 311 extends between the left and right side edges, and opens downwardly to accommodate the drive chain 23 therein. The tool retaining plates 314 are formed with an aligned pair of notches 315. The bottom wall of the lower box body 31 further has an upwardly vaunted portion 316 that confines the chain channel 311. The upwardly vaunted portion 316 is formed with a parallel pair of tool retaining plates 317 that project into the tool accommodating space 312. The tool retaining plates 317 are formed with an aligned pair of notches 318, and extend in a transverse direction relative to a longitudinal axis of the chain channel 311. Furthermore, the lower box body 31 is secured to the tray frame 21 of the machine frame 20 through the use of screws 33 passing through four corner through holes 313 in the bottom wall of the lower box body 31 and four threaded holes 211 in four corners of the tray frame 21. In addition, the lower box body 31 has a front side edge provided with a retaining hook 319.

The tool box 30 further includes an upper cover body 32 with a rear side edge hinged to the lower box body 31. The upper cover body 32 is movable relative to the lower box body 31 so as to selectively open and close the open top side of the lower box body 31. The upper cover body 32 further has a front side edge provided with a retainer 321 for engaging releasably the retaining hook 319 of the lower box body 31 when the upper cover body 32 closes the open top side of the lower box body 31.

By virtue of the configuration of the tool box 30, tools associated with planing can be conveniently stored therein without affecting the normal operation of the planing machine. Besides, the arrangement of the tool accommodating space 312 and the tool retaining plates 314, 317 facilitates handy storage of different tools.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A wood planing machine comprising:

a machine frame having an upper portion; and a tool box including a lower box body mounted securely on said upper portion of said machine frame, said lower box body defining a tool accommodating space adapted to receive tools therein and having an open top side, said tool box further including an upper cover body with a rear side edge hinged to said lower box body, said upper cover body being movable relative to said lower box body so as to selectively open and close said top side of said lower box body, wherein said machine frame includes a horizontal tray frame disposed at said upper portion of said machine frame, said lower box body being mounted on top of said tray frame, said wood planing machine further comprising:

a pair of sprockets mounted on said upper ends of said threaded rods;

an endless drive chain trained on said sprockets; and a cutter carriage carried by said threaded rods such that rotation of said threaded rods relative to said tray frame results in vertical movement of said cutter carriage along said threaded rods.

2. The wood planing machine of claim 1, wherein said lower box body has left and right side edges, and a bottom wall with a bottom surface formed with a chain channel, said chain channel extending between said left and right side edges and opening downwardly to accommodate said drive chain therein.

3. The wood planing machine of claim 2, wherein said upper cover body further has a front side edge provided with a retainer for engaging releasably said lower box body when said upper cover body closes said open top side of said lower box body.

4. The wood planing machine of claim 2, wherein said bottom wall of said lower box body further has a top surface formed with a parallel pair of upwardly projecting tool retaining plates, said tool retaining plates being formed with an aligned pair of notches.

5. The wood planing machine of claim 2, wherein said bottom wall of said lower box body has an upwardly vaunted portion that confines said chain channel, said upwardly vaunted portion being formed with a parallel pair of tool retaining plates that project into said tool accommodating space, said tool retaining plates being formed with an aligned pair of notches.

6. The wood planing machine of claim 5, wherein said tool retaining plates extend in a transverse direction relative to a longitudinal axis of said chain channel.

* * * * *